US005763100A

United States Patent [19]

Quick et al.

[11] Patent Number: 5,763,100

[45] Date of Patent: Jun. 9, 1998

[54] RECYCLABLE ACRYLIC COATED PAPER STOCKS AND RELATED METHODS OF MANUFACTURE

[75] Inventors: James R. Quick, Greenwood Lake; Donna J. Wenzel, Middleton; Gene W. Bartholomew, Tuxedo Park; Morton S. Delozier, Claryville; Maxine Klass-Hoffman, Highland Mills, all of N.Y.

[73] Assignee: International Paper Company, Purchase, N.Y.

[21] Appl. No.: 59,790

[22] Filed: May 10, 1993

[51] Int. Cl.[6] ..... B32B 27/10

[52] U.S. Cl. ..... 428/486; 428/511; 428/514; 428/537.5; 428/903.3

[58] Field of Search ..... 428/311.1, 311.7, 428/481, 486, 903.3, 511, 514, 537.5

[56] References Cited

U.S. PATENT DOCUMENTS

| | | | |
|---|---|---|---|
| 1,904,576 | 4/1933 | Twiss | 523/334 |
| 2,054,116 | 9/1936 | Abrams et al. | 154/50 |
| 2,229,356 | 1/1941 | Wiezevich | 91/68 |
| 2,252,091 | 8/1941 | Muller | 91/68 |
| 2,258,434 | 10/1941 | Abrams et al. | 91/68 |
| 2,298,846 | 10/1942 | Skooglund | 18/48 |
| 3,251,709 | 5/1966 | Bonzagni et al. | 117/76 |
| 3,260,690 | 7/1966 | Bohnert et al. | 260/29.7 |
| 3,369,932 | 2/1968 | Sawyer et al. | 117/161 |
| 3,400,008 | 9/1968 | Bleyle et al. | 117/76 |
| 3,874,905 | 4/1975 | Knights | 117/76 P |
| 3,876,578 | 4/1975 | Takada et al. | 260/29.6 RB |
| 3,922,244 | 11/1975 | Stephens et al. | 260/29.7 UA |
| 3,981,434 | 9/1976 | Ramich | 229/55 TS |
| 3,985,937 | 10/1976 | Fife | 428/486 |
| 4,010,307 | 3/1977 | Canard et al. | 428/327 |
| 4,117,199 | 9/1978 | Gotoh et al. | 428/486 |
| 4,241,142 | 12/1980 | Kaliski et al. | 428/511 |
| 4,326,006 | 4/1982 | Kaminstein | 428/204 |
| 4,360,147 | 11/1982 | Brauner | 229/33 |
| 4,471,904 | 9/1984 | Cassidy | 229/41 B |
| 4,714,727 | 12/1987 | Hume, III | 524/271 |
| 4,857,126 | 8/1989 | Soremark et al. | 156/205 |
| 5,126,390 | 6/1992 | Duff | 524/276 |

OTHER PUBLICATIONS

Technical Bulletin—Rohm & Haas, May 1991, "Products for Paper and Paperboard Coatings".

Technical Bulletin—Mobil Oil Corporation, Jun. 1986, "Mobil Product Data Sheet".

Technical Bulletin—Alco Chemical, Oct. 1992, "Alcogum Thickeners and Rheology Modifiers".

Technical Bulletin—Henkel Corporation, Jan. 1992, "Coatings and Inks".

*Primary Examiner*—James J. Bell
*Assistant Examiner*—Blaine R. Copenheaver
*Attorney, Agent, or Firm*—Dara L. Onofrio

[57] ABSTRACT

Recyclable paper stock comprising a substrate coated on at least one surface with a water based emulsion coating. The water based emulsion coating comprises 20–90 dry wt. % of an acrylic-styrene copolymer and 5–70 dry wt. % of a wax. In another embodiment a second water based emulsion coating comprised of an acrylic-styrene copolymer is coated on the substrate surface opposite the initial water based emulsion coating. The substrate may also be coated with a primer coat prior to the application of the water based emulsion coatings to seal the substrate surface. The invention also includes processes for making and using the invented acrylic coated paper stocks.

15 Claims, 3 Drawing Sheets

RECYCLABLE ACRYLIC COATED PAPER STOCKS AND RELATED METHODS OF MANUFACTURE

FIELD OF THE INVENTION

This invention generally relates to recyclable paper stocks and related methods of making the same useful as food packages or beverage containers having water resistance, grease resistance and limited moisture vapor transmission characteristics. More particularly, it concerns recyclable paper stocks comprised of a substrate coated on at least one surface with a water based emulsion coating. The water based emulsion coatings are readily recycled or breakdown more readily in a composting operation than conventional polyethylene or wax coatings.

BACKGROUND ART

Polyethylene films and wax coatings which are generally laminated or coated to paper are widely used in packaging applications to protect products from moisture and provide water or grease resistance. However, recycling of packaging containing polyethylene films and wax coating are limited and costly since special equipment is necessary for repulping. In addition, the polyethylene films and most wax coatings will not degrade if the package is composted.

The present invention provides recyclable paper stock comprised of a substrate coated on at least one surface with a water based emulsion coating. The water based emulsion coatings include an acrylic-styrene copolymer and a wax component. In another embodiment a second water based emulsion coating including an acrylic-styrene copolymer is coated on the substrate surface opposite the initial water based emulsion coating. The water based emulsion coatings of the invention are readily recycled or more readily breakdown in a composting operation than conventional polyethylene films or wax coatings.

A search of the prior art has shown that acrylic latexes and wax coatings have been used in paper packaging applications.

U.S. Pat. No. 3,874,905 to Knights discloses a process for coating liners of corrugated paperboards. The raw paper is coated with a styrene-butadiene rubber latex, dried and cured. A heavier coating of paraffin wax is applied over the rubber coat to form wax coated paper products having water resistance.

U.S. Pat. No. 3,981,434 to Ramich discloses a carton for ice cream and frozen comestibles which contains a liner sheet made of a plastic film, such as polyethylene, or metallic foil. The interior surface of the paperboard carton is wax coated. The liner sheet is adhered to the interior surface of the carton by an adhesive which may be an acrylic latex adhesive or a polyvinyl acetate adhesive which is preferred.

U.S. Pat. No. 4,010,307 to Canard discloses production of gloss papers using coating compositions including styrene and butadiene copolymers and alkyl acrylate-styrene copolymers as binders.

Both U.S. Pat. No. 4,471,904 to Cassidy and U.S. Pat. No. 4,360,147 to Brauner disclose paperboard food cartons for fast food items in which the interior of the cartons, optionally, may be coated with aqueous modified acrylic coatings to provide a liquid moisture barrier and grease resistance.

Finally, U.S. Pat. No. 4,857,126 to Soremark discloses a process for making coated paper products including a release agent composition to decrease the adhesion of paper rolls during production. In the production of corrugated board a first coating consisting of the release agent, wax and acrylic polymer adhesive is applied to a paperboard substrate followed by a second coating of the release composition.

From the prior art mentioned it is seen that acrylic latexes have been used in paper packaging applications as an adhesive or to provide water resistance, and wax coatings are generally used to provide water resistance, however none of these references teach the combination of acrylic latexes, such as acrylic-styrene copolymers and wax as a water based emulsion coating to provide recyclable paper stock useful as a food package or beverage container, having water resistance, grease resistance and limited moisture vapor transmission characteristics. The invention is directed to the provision of such recyclable paper stocks. It would be appreciated that advantage over known applications would be obtained by providing acrylic coatings which are more readily recycled than polyethylene films and wax coatings.

Accordingly, it is a broad object of the invention to provide a recyclable paper stock comprised of a substrate coated with a water based emulsion coating, having water resistance, grease resistance and limited moisture vapor transmission characteristics.

A more specific object of the invention is to provide a recyclable paper stock comprised of a substrate coated with a water based emulsion coating including an acrylic-styrene copolymer and wax component.

Another more specific object of the invention is to provide a recyclable paper stock comprised further of a second water based emulsion coating including an acrylic-styrene copolymer on the substrate surface opposite the initial water based emulsion coating.

Another object of the invention is to provide a recyclable paper stock which is formed into a package or container.

Another object of the invention is to provide a recyclable paper stock that complies with FDA regulations for food packaging and beverage container applications, including the regulations pertaining to the packaging of aqueous and fatty foods.

Another object of the invention is to provide a recyclable paper stock that can be made into food packages or beverage containers on standard converting machinery where seams, joints, end closures, etc. are formed by a heat sealing method such as hot bar sealing, hot air sealing or flame sealing. Alternately, the food packages or beverage containers can be sealed with hot melt adhesives or ultrasonically sealed.

A specific object of the invention is to provide a recyclable paper stock that can be manufactured without the dependence on extrusion coating equipment.

A more specific object of the invention is to provide a recyclable paper stock that is readily recycled without dependence on special equipment for repulping.

DISCLOSURE OF INVENTION

In the present invention, these purposes, as well as others which will be apparent, are achieved generally by coating at least one surface of a substrate with a water based emulsion coating comprised of 20–90 dry wt. % of an acrylic-styrene copolymer and 5–70 dry wt. % of a wax. Both the acrylic-styrene copolymer and wax component are provided in an aqueous emulsion form. The acrylic-styrene copolymer has a glass transition temperature below 50° C. The wax component is selected from the group comprising paraffin wax, microcrystalline wax, polyethylene wax or a blend of two or more of said waxes. The water based emulsion coatings may also contain between 0–60 dry wt. % of an acrylic polymer having a glass transition temperature above 30° C.

In another embodiment of the invention, a second water based emulsion coating is applied on the substrate surface opposite the initial water based emulsion coating. This second water based emulsion includes an acrylic-styrene copolymer component and may also include an acrylic polymer with a glass transition temperature above 30° C.

Other additional components of the coatings may include thickening agents, defoaming or antifoaming agents, pigments, crosslinking agents, slip additives, release agents and antiblocking agents.

Substrates employed in the invention include a variety of coated and uncoated paper and paperboard, including bleached or unbleached, hardwood or softwood, virgin or recycled, and clay coated or uncoated forms of paper or paperboard. The basis weight of the substrates are in the range of 80 to 300 lbs per 3,000 sq. ft. and the thicknesses range from 0.008 to 0.025 inches. A preferred substrate is paperboard and is selected from the group comprising bleached paperboard, clay coated bleached paperboard, unbleached paperboard or recycled paperboard.

The water based emulsion coatings are applied to the substrate surface as an aqueous emulsion. The aqueous water based emulsion coating is dried on the substrate surface to form a recyclable paper stock. The water based emulsion coatings have dry coating weights in the range of 1 to 15 lbs. per 3,000 sq. ft.

The degree of penetration of the coatings into the substrate surface is dependent on the type of substrate used. A more porous substrate generally results in more penetration of the water based emulsion coating. However, in an embodiment of the invention the substrate surface may be coated with a primer coat prior to the application of the subject water based emulsion coating. Generally, the primer coat is a water based coating and serves to seal a porous substrate surface. The primer coat is generally comprised of a water based dispersion of a polymer selected from the group comprising acrylic polymers, acrylic copolymers, polyvinyl acetate, polyvinyl alcohol, poly-ethylene vinyl acetate, poly-ethylene vinyl chloride, styrene butadiene copolymers, polyvinylidiene chloride, starch or any other polymer which is capable of sealing the substrate surface. The aforementioned polymer dispersions may be combined with other materials to impart specific characteristics to the primer coat. For example, a pigment or mineral filler such as clay may be used to provide improved leveling, smoothing and sealing of a rough or porous substrate.

The recyclable paper stock of the invention is formed into a food package or beverage container having water resistance, grease resistance and limited moisture vapor transmission. In preferred applications the water based emulsion coating corresponds to a water-resistant internal surface of the package or container and the second water based emulsion coating corresponds to the external surface of the food package or container.

The coating on the substrate surface which corresponds to the interior surface of a package or container performs two primary functions. It provides properties required for the containment of liquids or frozen foods; water resistance, grease resistance, limited moisture vapor transmission and FDA compliance. Second, it provides heat sealability so that the stock can be run on machines that produce packages with heat sealed seams, joints, end closures etc.

The additional coating or combination of coatings applied to the surface of the substrate which corresponds to the outside surface of a package or container can provide printability, moisture resistance, enhanced heat sealability and other functional characteristics desired on the package exterior.

Other objects, features, and advantages of the present invention will become apparent from the following detailed description of the best mode of practicing the invention when considered with reference to the drawings, as follows:

DETAILED DESCRIPTION OF THE PREFERRED EMBODIMENT

Figure 1:
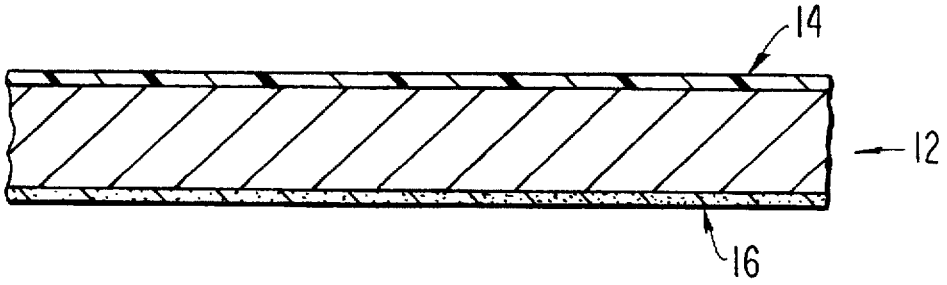
FIG. 1 is an illustration of a recyclable paper stock of the invention having a clay coated substrate and made in accordance with Example I.

In accordance with the invention as shown in FIGS. 1 to 6, recyclable paper stocks 10, are provided by coating at least one surface of a substrate 12, with a water based emulsion coating 14, comprised of 20–90 dry wt. % of an acrylic-styrene copolymer and 5–70 dry wt. % of a wax.

Both the acrylic-styrene copolymer and wax component are provided in an aqueous emulsion form. The acrylic-styrene copolymer component contains a combination of monomers including acrylic monomers, styrene and other copolymerizeable monomers. The acrylic-styrene copolymers used in the invention have a glass transition temperature below 50° C.

Generally the acrylic-styrene copolymers are available commercially or on an experimental basis under various tradenames and from various manufacturers. For example Rhoplex®P-376, which is a preferred copolymer used in the present compositions is an acrylic copolymer emulsion comprised of butyl acrylate, styrene and methacrylic acid and is available from Rohm and Haas, Independence Mall West, Philadelphia, Pa., 19105. Rhoplex®P-376 has a total solids content of 50%. This acrylic-styrene copolymer has a glass transition temperature (Tg) of 21° C. and a minimum film forming temperature of 8° C.

The wax component is selected from the group comprising paraffin wax, microcrystalline wax, polyethylene wax or a blend of two or more of said waxes. A preferred wax emulsion is Mobilcer® J which is a mixture of paraffin and microcrystalline wax and is available from Mobil Oil Corporation, 3223 Gallows Road, Fairfax, Va. 22037-0001. This emulsion has a wax melting point of 135° F.

The water based emulsion coating compositions may also include acrylic polymers having a glass transition temperature above 30° C. present between 0–60 dry wt. %. A preferred acrylic polymer is Rhoplex B-85® which is an acrylic polymer emulsion comprised mainly of methyl methacrylate and is also available from Rohm and Haas. Rhoplex B-85® has a total solids content of 38%. This acrylic polymer has a glass transition temperature (Tg) of 109° C. and a minimum film forming temperature of less than 90° C.

The water based emulsion coating containing both an acrylic-styrene copolymer component and an acrylic polymer component provides production of a paper or paperboard package or container having good heat sealing characteristics and blocking resistance. Generally, the presence of an acrylic-styrene copolymer provides good heat sealing characteristics while the presence of a harder acrylic polymer provides good blocking characteristics. Thus, the present invention formulations combine the two components to achieve both desired results.

Other additional components of the coatings may include thickening agents, defoaming or antifoaming agents, pigments, crosslinking agents, slip additives, release agents and antiblocking agents. A preferred polymer thickener used in the invention, as illustrated in the examples, includes Alcogum®L-36, an acrylic terpolymer emulsion, which is a reactive, acidic thickening agent of the type commonly referred to as an in-situ thickener. Alcogum®L-36 is available from Alco Chemical (a division of National Starch and Chemical Company) P.O. Box 5401, 909 Mueller Drive, Chattanooga, Tenn., 37406-0401. Also the defoaming agent used in the examples of the invention includes Foamaster®R defoamer, available from Henkel Corporation, 300 Brookside Avenue, Ambler, Pa., 19002, and is comprised of 100% petroleum derivatives and other additives. It is generally insoluble in water but dispersible in surfactant systems.

Substrates employed in the invention include a variety of coated and uncoated paper and paperboard, including bleached or unbleached, hardwood or softwood, virgin or recycled, clay coated or uncoated forms of paper or paperboard. The basis weight of the substrates are in the range of 80 to 300 lbs per 3,000 sq. ft. and the thicknesses range from 0.008 to 0.025 inches. A preferred substrate is paperboard and is selected from the group comprising bleached paperboard, clay coated bleached paperboard, unbleached paperboard or recycled paperboard.

The process of manufacturing the recyclable paper stock of the invention comprises the steps of applying a water based emulsion coating to at least one surface of a substrate and drying the emulsion coating on the substrate to form the recyclable paper stock. The wet coating formulation, as applied to the substrate, is comprised of 15–90 wet wt. % of an acrylic styrene copolymer emulsion and 5–85 wet wt. % of a wax emulsion. The wet composition coating may further comprise between 0–75 wet wt. % of an acrylic polymer emulsion having a glass transition temperature above 30° C. The wet coating formulation also contains 30–80 wet wt. % of water which is removed in the drying step. The water based emulsion coatings of the invention have dry coating weights in the range of 1 to 15 lbs per 3,000 sq. ft. Drying temperatures and line speeds are dictated by the drying characteristics of specific coating formulations, for example the % solids content, substrate basis weight and absorptivity, and equipment characteristics. Drying conditions are controlled to prevent blistering of the coating and roll blocking or picking of the coating during rewinding of the coated substrate.

The water based emulsion coatings are applied to the substrate surface as an aqueous emulsion. The degree of penetration of the coatings into the substrate surface is dependent on the type of substrate used. A more porous substrate generally results in more penetration of the water based emulsion coating. However, in an embodiment of the invention the substrate surface may be coated with a primer coat prior to the application of the water based emulsion coatings.

If a primer coat is used the substrate is coated in a two step process. The first step applies a primer coat that seals a porous substrate. The primer is applied using conventional coating equipment such as rotogravure, flexographic, air knife, blade or Meyer rod coaters. The primer coat is generally dried prior to the application of the water based emulsion coating of the invention.

The primer coat is generally is comprised of a water based coating and will typically be of a different composition than the water based emulsion coating of the invention. The primer in itself decreases the penetration of the subject water based emulsion coatings into the substrate. Examples of materials that comprise the primer coat are water based dispersions of a polymer selected from the group comprising acrylic polymers, acrylic copolymers, polyvinyl acetate, polyvinyl alcohol, poly-ethylene vinyl acetate, poly-ethylene vinyl chloride, styrene butadiene copolymers, poly-vinylidiene chloride, or starch. However primers based on other polymers which are capable of sealing the substrate surface are also included. The aforementioned polymer dispersions may be combined with other materials to impart specific characteristics to the primer coat. For example, a pigment or mineral filler such as clay may be used to provide improved leveling, smoothing and sealing of a rough or porous substrate.

Figure 2:
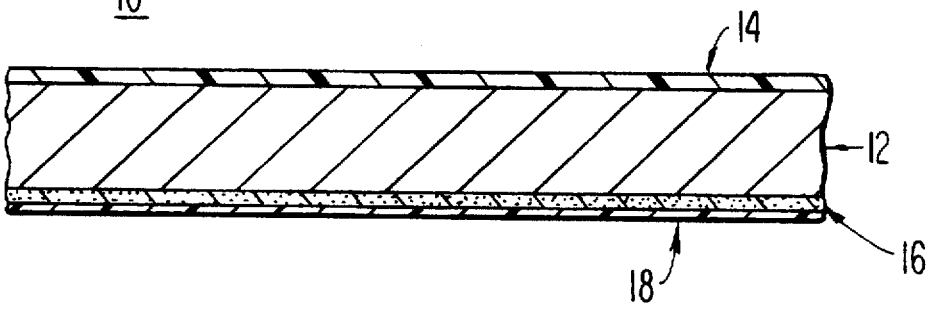
FIG. 2 is an illustration of a recyclable paper stock of the invention having a clay coated substrate, having two water based emulsion coatings and made in accordance with Example II.
Figure 3:
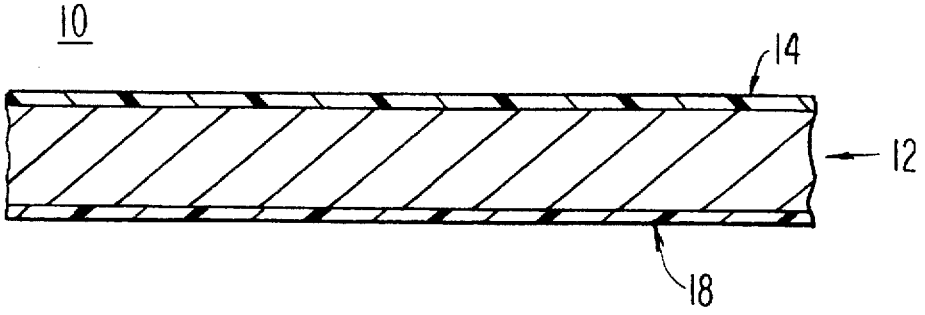
FIG. 3 is an illustration of a recyclable paper stock of the invention having two water based emulsion coatings and made in accordance with Example III.

In alternate embodiments of the invention, as shown in FIGS. 2 and 3, a second water based emulsion coating is applied to a surface of the substrate opposite the initial water based emulsion coating. This second water based emulsion coating is comprised of an acrylic-styrene copolymer. This second coating may also include an acrylic polymer with a glass transition temperature above 30° C.

The water based emulsion coatings of this invention may be applied to the substrate by any method of coating suitable for water based coatings. Examples of suitable coating methods include conventional methods such as air knife coating, blade coating, metering roll coating, gravure coating, rod coating, curtain coating and spraying. Generally some type of elevated temperature drying will be required in order to dry the water based emulsion coatings at an acceptable production speed. Suitable drying methods include hot air drying, infrared drying, direct flame drying and drying by contact with a heated drum.

The recyclable paper stock of the invention is formed into a food package or beverage container having water resistance, grease resistance and limited moisture vapor transmission characteristics. In preferred applications the initial water based emulsion coating corresponds to an internal surface of the package or container and the second water based emulsion coating, when used, corresponds to an external surface of the food package or beverage container.

As shown in the Examples below and in FIGS. 1 to 6, the water based emulsion coating 14, on the surface which corresponds to the interior surface of a package or container performs two primary functions. It provides properties required for the containment of liquids or frozen foods; water resistance, grease resistance, limited moisture vapor transmission and FDA compliance. Second, it provides heat sealability so that the stock can be run on machines that produce packages with heat sealed seams, joints, end closures etc.

As shown in FIGS. 2 and 3, the optional coating 18, applied on the surface which corresponds to the outside surface of a package or container can provide printability, moisture resistance, enhanced heat sealability and other functional characteristics desired on the package exterior.

The following Examples I through VI below, show various forms and compositions of the recyclable paper stock of the invention. Specifically Example I illustrates a recyclable paper stock comprised of a clay coated substrate with a water based emulsion coating on the surface opposite the clay coating. Example II is comprised of a clay coated substrate with water based emulsion coatings on each surface of the substrate. Example III is similar to Example II except the substrate is not clay coated. Example IV is similar to Example I except the substrate is not clay coated. Example V is similar to Example I except the substrate is clay coated on both sides. Example VI is similar to Example I except a primer coat is applied to the substrate prior to the application of the water based emulsion coating. In Examples I to VI reference is made to corresponding FIGS. 1 to 6 which illustrate the construction of the coated stocks as a package or container provided by each of the examples. These examples are merely representative and are not inclusive of all the possible embodiments of the invention.

EXAMPLE I

The substrate in this Example is comprised of a solid bleached sulfate (SBS) paperboard basestock from International Paper Company, Grade 1305, with a standard mill-applied clay coating on one surface of the substrate. The nominal basis weight of the basestock is 165 lb. per 3,000 sq. ft. and the nominal caliper (thickness) is about 0.014 inches.

The following water based emulsion coating is applied to the substrate surface opposite the clay coating.

| Composition Component | Approximate % Wet Coating Weight |
|---|---|
| ○acrylic-styrene copolymer emulsion | 70% |
| ○○acrylic polymer emulsion | 10% |
| ○○○paraffin and microcrystalline wax emulsion | 20% |
| +polymer thickening agent | 0.2% |
| ++defoaming agent | 0.05% |

○Rhoplex ®P-376 acrylic-styrene copolymer emulsion, by Rohm and Haas Company
○○Rhoplex B-85 ® acrylic polymer emulsion, by Rohm and Haas Company
○○○Mobilcer ® J paraffin and microcrystalline wax emulsion, by Mobil Oil Corporation
+Alcogum ® L-36 acrylic polymer thickening agent in water, by Alco Chemical
++Foamaster ® R defoaming agent, by Henkel Corporation The water based emulsion coating is dried on the substrate to form a recyclable paper stock shown in FIG. 1. The water based emulsion coating has a dry coating weight of about 8–9 lbs. per 3,000 sq. ft. The resulting stock is suitable for the manufacture of beverage containers or food packaging. As shown in FIG. 1 the water based emulsion coating 14 corresponds to the interior surface of a package or container and imparts water resistant characteristics on that surface. The clay coated surface 16 corresponds to the exterior surface of the package or container and is suitable for printing.

EXAMPLE II

The substrate in this Example is comprised of an SBS paperboard basestock from International Paper Company, Grade 1305, as described in Example I.

The following water based emulsion coating is applied to the substrate surface opposite the clay coating.

| Composition Component | Approximate % Wet Coating Weight |
|---|---|
| ○acrylic-styrene copolymer emulsion | 75% |
| ○○○paraffin and microcrystalline wax emulsion | 25% |
| +polymer thickening agent | 0.1% |
| ++defoaming agent | 0.05% |

○Rhoplex ®P-376 acrylic-styrene copolymer emulsion, by Rohm and Haas Company
○○○Mobilcer ® J paraffin and microcrystalline wax emulsion, by Mobil Oil Corporation
+Alcogum ® L-36 acrylic polymer thickening agent in water, by Alco Chemical
++Foamaster ® R defoaming agent, by Henkel Corporation The water based emulsion coating is dried on the substrate and has a dry coating weight of about 8–9 lbs. per 3,000 sq. ft. A second water based emulsion coating is then applied over the clay coated surface of the substrate. The second water based emulsion coating composition is as follows:

| Composition Component | Approximate % Wet Coating Weight |
|---|---|
| ○acrylic-styrene copolymer emulsion | 75% |
| ○○acrylic polymer emulsion | 25% |
| ++defoaming agent | 0.05% |

○Rhoplex ®P-376 acrylic-styrene copolymer emulsion, by Rohm and Haas Company
○○Rhoplex B-85 ® acrylic polymer emulsion, by Rohm and Haas Company
++Foamaster ® R defoaming agent, by Henkel Corporation This second water based coating is dried on the substrate to form a recyclable paper stock shown in FIG. 2. The second water based emulsion has a dry coating weight of about 1–2 lbs. per 3,000 sq. ft. The resulting stock is suitable for the manufacture of beverage containers or food packaging. As shown in FIG. 2 the water based emulsion coating 14 corresponds to the interior surface of a package or container and imparts water resistance and grease resistance on that surface. The second water based emulsion coating 18, applied on the clay coated surface of the substrate 16, corresponds to the exterior surface of the package or container and provides moisture resistance on that surface.

EXAMPLE III

The substrate in this Example is comprised of an SBS paperboard basestock from International Paper Company, Grade 1339. Unlike, previous Examples I and II this substrate is not clay coated. The nominal basis weight of the basestock is 155 lb. per 3,000 sq. ft. and the nominal caliper (thickness) is about 0.014 inches.

The following water based emulsion coating is applied to one surface of the substrate.

| Composition Component | Approximate % Wet Coating Weight |
|---|---|
| ○acrylic-styrene copolymer emulsion | 50% |
| ○○acrylic polymer emulsion | 40% |
| ○○○paraffin and microcrystalline wax emulsion | 10% |

-continued

| Composition Component | Approximate % Wet Coating Weight |
|---|---|
| +polymer thickening agent | 0.5% |
| ++defoaming agent | 0.05% |

°Rhoplex ®P-376 acrylic-styrene copolymer emulsion, by Rohm and Haas Company
°°Rhoplex B-85 ® acrylic polymer emulsion, by Rohm and Haas Company
°°°Mobilcer ® J paraffin and microcrystalline wax emulsion, by Mobil Oil Corporation
+Alcogum ® L-36 acrylic polymer thickening agent in water, by Alco Chemical
++Foamaster ® R defoaming agent, by Henkel Corporation The water based emulsion coating is dried on the substrate and has a dry coating weight of about 10–11 lbs. per 3,000 sq. ft. A second water based emulsion coating is applied on the surface of the substrate opposite the initial water based emulsion coating. The second water based emulsion coating

| Composition Component | Approximate % Wet Coating Weight |
|---|---|
| °acrylic-styrene copolymer emulsion | 50% |
| °°acrylic polymer emulsion | 50% |
| +polymer thickening agent | 0.5% |
| ++defoaming agent | 0.1% |

°Rhoplex ®P-376 acrylic-styrene copolymer emulsion, by Rohm and Haas Company
°°Rhoplex B-85 ® acrylic polymer emulsion, by Rohm and Haas Company
+Alcogum ® L-36 acrylic polymer thickening agent in water, by Alco Chemical
++Foamaster ® R defoaming agent, by Henkel Corporation This water based emulsion coating is dried on the substrate to form a recyclable paper stock shown in FIG. 3. The second water based emulsion coating has a dry coating weight of about 9–10 lbs. per 3,000 sq. ft. The resulting stock is suitable for the manufacture of beverage containers or food packaging. As shown in FIG. 3 the water based emulsion coating 14 corresponds to the interior surface of a package or container. The second water based emulsion coating 18, applied on the surface of the substrate opposite the initial water based emulsion coating, corresponds to the exterior surface of the package or container.

EXAMPLE IV

The substrate in this Example is comprised of an SBS paperboard basestock from International Paper Company, Grade 1334. Similar to Example III this substrate is not clay coated. The nominal basis weight of the basestock is 145 lb. per 3,000 sq. ft. and the nominal caliper (thickness) is about 0.0135 inches.

The following water based emulsion coating is applied to at least one surface of the substrate.

| Composition Component | Approximate % Wet Coating Weight |
|---|---|
| °acrylic-styrene copolymer emulsion | 54% |
| °°acrylic polymer emulsion | 27% |
| °°°paraffin and microcrystalline wax emulsion | 10% |
| water | 9% |

Figure 4:
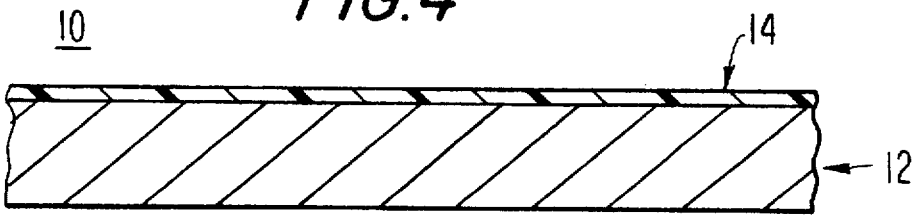
FIG. 4 is an illustration of a recyclable paper stock of the invention made in accordance with Example IV.

°Rhoplex ®P-376 acrylic-styrene copolymer emulsion, by Rohm and Haas Company
°°Rhoplex B-85 ® acrylic polymer emulsion, by Rohm and Haas Company
°°°Mobilcer ® J paraffin and microcrystalline wax emulsion, by Mobil Oil Corporation The water based emulsion coating is dried on the substrate to form a recyclable paper stock shown in FIG. 4. The water based emulsion coating has a dry coating weight of about 10 lbs. per 3,000 sq. ft. The resulting stock is suitable for the manufacture of beverage containers or food packaging. As shown in FIG. 4 the water based emulsion coating 14 corresponds to the interior surface of a package or container and imparts water resistant characteristics on that surface.

EXAMPLE V

The substrate in this Example is comprised of an SBS paperboard basestock from International Paper Company, Grade 6816 with standard mill applied clay coatings on both surfaces. The nominal basis weight of the basestock is 201 lb. per 3,000 sq. ft. and the nominal caliper (thickness) is 0.016 inches.

The following water based emulsion coating is applied to at least one of the clay coated surfaces of the substrate:

| Composition Component | Approximate % Wet Coating Weight |
|---|---|
| °acrylic-styrene copolymer emulsion | 50% |
| °°acrylic polymer emulsion | 25% |
| °°°paraffin and microcrystalline wax emulsion | 25% |
| +polymer thickening agent | 0.4% |
| ++defoaming agent | 0.05% |

Figure 5:
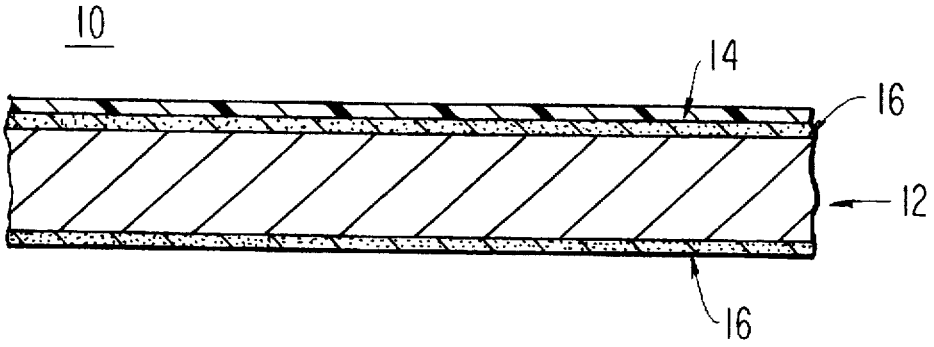
FIG. 5 is an illustration of a recyclable paper stock of the invention having a two-sided clay coated substrate and made in accordance with Example V.

°Rhoplex ®P-376 acrylic-styrene copolymer emulsion, by Rohm and Haas Company
°°Rhoplex B-85 ® acrylic polymer emulsion, by Rohm and Haas Company
°°°Mobilcer ® J paraffin and microcrystalline wax emulsion, by Mobil Oil Corporation
+Alcogum ® L-36 acrylic polymer thickening agent in water, by Alco Chemical
++Foamaster ® R defoaming agent, by Henkel Corporation The water based emulsion coating is dried on the substrate and has a dry coating weight of about 4 lbs. per 3,000 sq. ft. The resulting recyclable paper stock is suitable for the manufacture of beverage containers or food packaging. As shown in FIG. 5 the water based emulsion coating 14, corresponds to the interior surface of the package or container. The opposite clay coated surface 16 corresponds to the exterior surface of the package or container.

EXAMPLE VI

The substrate in this Example is comprised of solid bleached sulfate (SBS) paperboard basestock from International Paper Company, Grade 1305, as described in Example I. This basestock has a standard mill applied clay coating on one surface. A primer coat was applied on the substrate surface opposite the clay coating. The primer coating was of the following composition:

| Composition Component | Approximate % Wet Coating Weight |
|---|---|
| °polyvinyl acetate emulsion | 6.5% |
| °°starch | 3.2% |
| °°°clay | 32.3% |
| water | 58.0% |
| *crosslinking agent | 0.08% |

-continued

| Composition Component | Approximate % Wet Coating Weight |
|---|---|
| **dispersant | 0.04% |
| +polymer thickening agent | 0.2% |

Figure 6:
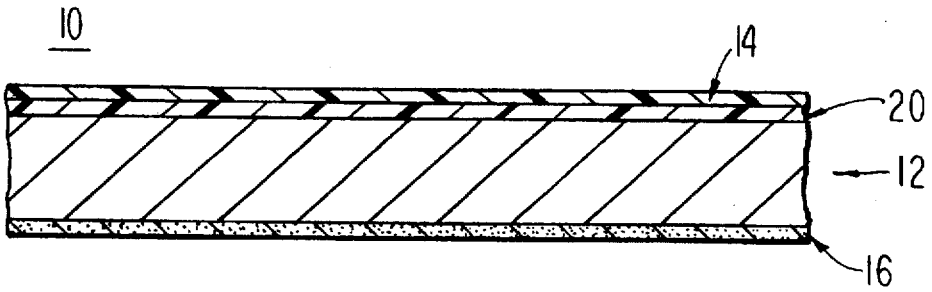
FIG. 6 is an illustration of a recyclable paper stock of the invention with a primer coat applied to the substrate and made in accordance with Example VI.

○NS ®119 polyvinyl acetate emulsion from National Starch and Chemical, 10 Finerdne Ave., Bridgewater, New Jersey, 08807
○○PG ®280 starch from Penford Products Co., P.O. Box 428, Cedar Rapids, Iowa, 52406
○○○Hydrafine No. 1 clay from J. M. Huber Corp., Clay Division, Route 4, Macon, Georgia, 31298
*Parex ®707 crosslinker from American Cyanamid Corp., One Cyanamid Plaza, Wayne, New Jersey, 07470
**Tamol ®850 dispersant from Rohm & Haas Co.
+Alcogum ® L-36 acrylic polymer thickening agent in water, by Alco Chemical The primer coating is dried on the substrate and has a dry coating weight of about 5 lbs. per 3,000 sq. ft. A water based emulsion coating is then applied over the primer coated surface. The water based emulsion coating is the same as the first water based emulsion coating described in Example III. The water based emulsion coating is dried on the substrate to form a recyclable paper stock as shown in FIG. 6. The water based emulsion coating has a dry coating weight of about 7 lbs. per 3,000 sq. ft. The resulting stock is suitable for the manufacture of beverage containers and food packaging. As shown in FIG. 6 the water based emulsion coating 14 is applied over the primer coat 20 and corresponds to the interior surface of a package or container and imparts water resistance to that surface. The clay coated surface 16 corresponds to the exterior surface of the package or container and is suitable for printing.

In Examples I to VI above, the recyclable paper stocks showed satisfactory liquid retention characteristics when formed into beverage containers. In particular, cups for cold beverages, such as carbonated beverages, can be manufactured from the stocks provided by Examples I through VI. The heat sealability afforded by the initial water based emulsion coating, and supplemented in some cases by a second water based emulsion coating, makes possible the manufacture of cups with heat sealed side seams and bottoms. Alternately cups can be manufactured from these stocks using a hot melt adhesive to seal the side seams and bottoms. A suitable hot melt adhesive for this purpose is Macromel®6211, a polyamide hot melt adhesive supplied by Henkel Corp., 5325 South 9th Avenue, La Grange, Ill., 60525-3602. As another alternative, the seals may be formed by ultrasonic sealing. Cups manufactured from the recyclable paper stocks of the invention exhibit a level of resistance to penetration by cold beverages in excess of that required for this application due to the inherent moisture resistance of the coating that includes an acrylic-styrene copolymer and a wax. All the Examples described provide recyclable paper stocks which can be formed into beverage containers that are resistant to staining, exhibit no contamination of the beverage and comply with FDA regulations. In particular the recyclable paper stocks produced in Examples I, V and VI also provide excellent printing characteristics on the exterior surface of the substrate having the clay coated surface. In Examples II and III the exterior surface of the substrate having the second water based emulsion coating exhibits superior moisture resistance. In Examples V and VI, where the water based emulsion coatings are applied over a clay coating and a primer coating respectively, the water based emulsion coatings are smoother, glossier and have a higher integrity than the water based emulsion coatings of Examples I to IV.

In addition to beverage containers bakery trays and boxes for baked goods such as breakfast pastries and coffee cakes can be manufactured from the recyclable paper stocks of Examples I through VI. The moisture resistance and grease resistance required for the containment of baked goods is provided by the coating that includes an acrylic-styrene copolymer and a wax. This coating can be used for the interior surface of packages for the distribution and storage of bakery items. The other characteristics of the stocks of this invention that have been described relative to beverage cups are equally relevant to the manufacture of packages for baked goods. Side seams, end flaps and other closures on bakery packages may be formed by heat sealing, hot melt gluing or ultrasonic sealing.

Repulping studies have been conducted to assess the recyclablility of the paper stocks of the invention. The subject stocks can be repulped using standard equipment such as a hydropulper where the stock is mixed with water and subjected to a vigorous agitation. The stocks of the invention can be redispersed without the use of elevated temperature or the addition of chemicals. Paper sheets formed from the redispersed material are free of fiber bundles and no pieces of the acrylic coating are evident, even when the sheets are examined under magnification. When the stocks of the invention are compared with the corresponding basestocks without acrylic coatings, longer dispersion times are generally required for the acrylic coated stocks to achieve a comparable level of uniform fiber distribution in the recycled paper sheet. Additional agitation of the mixture of fiber and water eliminates any difference between the results for the acrylic coated stocks and the uncoated basestocks. When the stocks of the invention are compared with conventional polyethylene coated stocks the superior recyclability of the acrylic coated stocks becomes evident. The polyethylene coated stocks will not provide acceptable recycled paper sheets regardless of the dispersion time because of the presence of large pieces of polyethylene film.

As described the substrate basestocks, water based emulsion coating compositions and water based emulsion coating weights of Examples I to VI are only representative of the various embodiments of the invention. The water based emulsion coating weights on the substrate can be varied according to the requirements of the application being served. For instance, the coating weight on the interior surface of a package or container for certain applications could be much lower than 8–11 lbs. per 3,000 sq. ft. Also, other acrylic-styrene copolymer emulsions, acrylic polymer emulsions and wax emulsions may be used instead of the Rhoplex® emulsions and Mobilcer®J emulsion. Additional coating composition ingredients may also be used including pigments, crosslinking agents, slip additives, release agents or antiblocking agents.

The present invention provides two primary advantages over prior practice. First the invention provides a paper stock which can be recycled by conventional methods without any special measures to remove polyethylene or wax coatings. The water based emulsion coatings of the invention breakup and disperse with the paper fibers when the material is run through a standard hydropulper. Second, the paper stock of the invention can be manufactured using machinery that can handle only water-based coatings, e.g. the coating sections on a paper machine, thus avoiding the need for polyethylene extrusion coating equipment or a waxing operation.

The utilization of conventional process lines and the elimination of the need for special extrusion equipment or wax coating equipment provide a low cost paper stock. It will be recognized by those skilled in the art that the paper stocks of the invention and process have wide application in the production of food packages or beverage containers having water resistance, grease resistance and limited moisture vapor transmission characteristics.

Advantageously, the paper stocks of the invention are less complex to manufacture than polyethylene coated stocks, and the subject paper stocks are more readily recycled than conventional polyethylene or wax coated stocks. Also, the paper stocks of the invention will breakdown more readily in a landfill or composting operation than conventional polyethylene or wax coated stocks.

Finally, variations of the water based emulsion coating compositions and coated products from the examples given herein are possible in view of the above disclosure. Therefore, although the invention has been described with reference to certain preferred embodiments, it will be appreciated that other composite structures and processes for their fabrication may be devised, which are nevertheless within the scope and spirit of the invention as defined in the claims appended hereto.

We claim:

1. A recyclable paper stock comprising:

a substrate coated on at least one surface with a water based emulsion coating;

said coating consisting essentially of:

20–90 dry wt. % of an acrylic-styrene copolymer which consists essentially of acrylic monomers and styrene having a glass transition temperature below 50° C.;

5–70 dry wt. % of a wax component selected from the group consisting of paraffin wax, microcrystalline wax, polyethylene wax and a blend of two or more of said waxes; and an acrylic polymer having a glass transition temperature above 30° C. present in an amount up to 60 dry wt. % in order to provide good blocking characteristics;

wherein said coating forms a water resistant film on said substrate surface.

2. A recyclable paper stock as defined in claim 1, wherein said substrate surface is coated with a primer coat prior to the application of said water based emulsion coating to substantially seal said substrate surface;

said primer coat consisting essentially of at least one or more of a pigment; mineral filler; or a water based dispersion of a polymer selected from the group consisting of acrylic polymers, acrylic copolymers, polyvinyl acetate, polyvinyl alcohol, poly-ethylene vinyl acetate, poly-ethylene vinyl chloride, styrene butadiene copolymers, polyvinylidiene chloride and starch.

3. A recyclable paper stock as defined in claim 1, wherein said substrate is paperboard and is selected from the group consisting of bleached paperboard, clay coated paperboard, unbleached paperboard and recycled paperboard.

4. A recyclable paper stock as defined in claim 1, wherein said substrate has a basis weight in the range of 80 to 300 lbs per 3,000 sq. ft. and a thickness in the range of 0.008 to 0.025 inches.

5. A recyclable paper stock as defined in claim 1, wherein said water based emulsion coating has a dry coating weight in the range of 1 to 15 lbs per 3,000 sq. ft.

6. A recyclable paper stock as defined in claim 1, wherein said substrate is a clay coated paperboard, wherein at least one surface of said substrate is clay coated.

7. A recyclable paper stock as defined in claim 1, wherein said substrate is a clay coated paperboard, wherein both surfaces of said substrate are clay coated.

8. A recyclable paper stock as defined in claim 1, further comprising a second water based emulsion coating coated on a surface of said substrate opposite said water based emulsion coating, wherein said second water based emulsion coating is comprised of an acrylic-styrene copolymer.

9. A recyclable paper stock as defined in claim 8, wherein said second water based emulsion coating is further comprised of an acrylic polymer with a glass transition temperature above 30° C.

10. A recyclable paper stock as defined in claim 8, wherein said substrate is a clay coated paperboard having at least one surface which is clay coated and said second water based emulsion coating is coated on said clay coated surface.

11. A recyclable paper stock as defined in claim 8, which is formed into a package or container, wherein said second water based emulsion coating is an external surface of said package or container.

12. A recyclable paper stock as defined in claim 1, which is formed into a package or container.

13. A recyclable paper stock as defined in claim 12, wherein said water based emulsion coating is a water-resistant internal surface of said package or container.

14. A recyclable paper stock comprising:

a substrate coated on at least one surface with a water based emulsion coating;

said coating consisting essentially of:

20–90 dry wt. % of an acrylic-styrene copolymer having a glass transition temperature below 50° C. and an acrylic polymer having a glass transition temperature above 30° C. present in an amount up to 60 dry wt. % in order to provide good blocking characteristics;

wherein said coating forms a water resistant film on said substrate surface.

15. A recyclable paper stock as defined in claim 14, wherein said substrate is paperboard and is selected from the group consisting of bleached paperboard, clay coated paperboard, unbleached paperboard and recycled paperboard.

* * * * *